United States Patent [19]

Borchardt

[11] Patent Number: 4,732,516

[45] Date of Patent: Mar. 22, 1988

[54] LASHING BAR

[76] Inventor: Dieter Borchardt, Rissener Dorfstr. 45, 2000 Hamburg 56, Fed. Rep. of Germany

[21] Appl. No.: 2,313

[22] Filed: Jan. 12, 1987

[30] Foreign Application Priority Data

Jan. 15, 1986 [DE] Fed. Rep. of Germany ... 8601121[U]

[51] Int. Cl.[4] ..... B63B 25/28; B60P 7/13

[52] U.S. Cl. ..... 410/77; 114/75; 410/82; 24/265 CD; 24/590; 248/500

[58] Field of Search ..... 410/31, 32, 34, 46, 410/52, 77, 82, 85, 90, 91, 101, 102; 24/265 CD, 287, 588, 590; 211/105.1, 123; 248/499, 500; 114/75; 403/348, 353

[56] References Cited

U.S. PATENT DOCUMENTS 4,249,840 2/1981 Kallaes et al. ..... 410/85 X
4,537,539 8/1985 Borchardt ..... 410/77

FOREIGN PATENT DOCUMENTS 2345379 3/1975 Fed. Rep. of Germany ..... 410/77
3501109 7/1986 Fed. Rep. of Germany ..... 410/77

*Primary Examiner*—Robert B. Reeves
*Assistant Examiner*—Scott H. Werny
*Attorney, Agent, or Firm*—Cushman, Darby & Cushman

[57] ABSTRACT

A lashing bar of the type shown in Borchardt U.S. Pat. No. 4,537,539, has the mirror image hooking-in fittings which are provided on the upper end of its bar portion disposed at less than 180 degrees to one another about the longitudinal axis of the bar portion so that two of them can be used in close juxtaposition with one another for hooking into vertically adjacent corners of two containers stacked on one another, the two hooking-in fittings on each bar being used alternatively, depending on whether the container corners are right corners or left corners.

8 Claims, 4 Drawing Figures

LASHING BAR

BACKGROUND OF THE INVENTION

The invention relates to a lashing bar for securingly hanging in an anchoring opening of a container corner, with a selected one of two hooking-in fittings provided at the upper end and which in each case have a pin extending substantially at right angles to the bar and to which is fixed a hooking-in portion, which is asymmetrical with respect to the plane in which the central axis of the bar is located and to which the longitudinal axis of the pin portion connected to the hooking-in portion is parallel, so that the first side of the hooking-in portion projects further laterally over the plane than the facing, second side and which with the hooking-in fitting hung into an anchoring opening and the bar pivoted into the clamping position engages behind respective marginal regions of the anchoring opening, one of the hooking-in portions being constructed for engaging behind the marginal regions of the anchoring opening when the lower end of the bar is pivoted to one side of the extension of the vertical axis of the anchoring opening and the other hooking-in portion being constructed for engaging behind the marginal regions of the anchoring opening when the lower end of the bar is pivoted to the other side of the extension of the vertical axis of the anchoring opening and the two hooking-in portions are homologous to a plane located between them.

In a known lashing bar of this type (see, e.g., Borchardt, U.S. Pat. No. 4,537,539, issued Aug. 27, 1985) the hooking-in fittings precisely face one another at the upper end of the bar (i.e. are diametrically opposed with respect to the longitudinal axis of the bar), so that the plane to which the hooking-in portions are homologously constructed (i.e. the plane of symmetry) is parallel to the hooking-in portions. The actual hooking-in portions in each case comprise a locking lug, which at least approximately extends in the longitudinal direction of the bar and from the pin in the direction away from the remote bar end and an additional locking lug, which extends substantially at right angles to the pin and at right angles to the locking lug, the locking lug and the additional locking lug being located in one plane. The locking lug has a maximum width less than the maximum width of the anchoring opening of a lower container corner and the distance between the free end of the locking lug and its facing end or the surface of the pin remote from the free end of the locking lug is smaller than the height of the anchoring opening of a lower container corner, but sufficiently large for the locking lug in the clamped position to engage behind the marginal region of the end-face anchoring opening of an upper container corner. In the clamping position, i.e. in the position in which the lower end of the bar is laterally pivoted out of the vertical axis of the anchoring opening, the additional locking lug extends behind the marginal region of the end-face anchoring opening, which faces the marginal region behind which the locking lug engages. The lower end of the pivoted bar is on the same side of the vertical axis through the anchoring opening as the free end of the additional locking lug, whilst the free end of the locking lug is on opposite side of said axis.

By means of the known lashing bar described in detail in Borchardt U.S. Pat. No. 4,537,539, a reliable anchoring of the lashing bar is possible both in the narrower anchoring openings in the lower container corners and the lateral anchoring openings in the upper container corners, as well as in the wider anchoring openings provided at the end face on the upper container corners, whilst as a result of the homologously facing asymmetrical hooking-in portions, one hooking-in fitting is suitable for use in a clamping position with the bar extending to the bottom right and the other hooking-in fitting is intended for use in a clamping position with the bar extending to the bottom left.

A difficulty when using the known lashing bar is that the hooking-in fitting facing the hooking-in fitting which has been hung-in is in the way if it is necessary to lash down a container resting on the container, in whose upper anchoring opening the lashing bar is hung. Due to the projecting length of the free hooking-in fitting in the outwards direction, it is then extremely difficult and often impossible to make a further, correspondingly constructed lashing bar engage with an immediately superimposed anchoring opening of the upper container, reference being made thereto in Borchardt U.S. Pat. No. 4,537,539.

SUMMARY OF THE INVENTION

The problem of the present invention is to so construct a lashing bar with hooking-in fittings at the upper end, that the free hooking-in fitting with the lashing bar in the clamping position does not prevent the hanging in of another lashing bar in the anchoring opening of a container positioned above it.

According to the invention this problem is solved in that a lashing bar of the aforementioned type is constructed in such a way that the longitudinal axis of the portions of the pin connected to the hooking-in portion form an angle smaller than 180° and in a plane normal to the central axis of the bar. The spacing between the lateral end regions of the first sides of the hooking-in portions is larger than the spacing between the lateral end regions of the second sides of the hooking-in portions. The angle formed by the longitudinal axes is preferably approximately 90° to 165° and in particular approximately 90° to 120°.

In the inventive lashing bar, unlike in the known lashing bar, the hooking-in portions of the two hooking-in fittings no longer precisely face one another and instead their laterally less projecting regions are brought closer together.

Thus, with the hooking-in fitting hung in and the bar in the clamping position, the free hooking-in fitting is pivoted sideways with respect to the region of the container opening receiving the hung-in hooking-in fitting. Thus, this pivoted hooking-in fitting is also positioned laterally with respect to the anchoring opening in the lower container corner of the mounted container located immediately above it, so that a further lashing bar can be passed in unimpeded manner through the free hooking-in fitting into said upper anchoring opening and the associated lashing bar can be pivoted into the clamping position.

It is pointed out that the pivoting of the free hooking-in fitting, i.e. the size of the angle between the longitudinal axes of the pin portions connected onto the hooking-in portions is largely dependent on the extent of the projection of the hooking-in fitting side which projects furthest sideways. In general, the angle should be chosen in such a way that the free hooking-in fitting is displaced sufficiently with respect to the zone required for hanging a further lashing bar into an anchoring opening located above it.

BRIEF DESCRIPTION OF THE DRAWINGS

The invention is described in greater detail hereinafter relative to an embodiment shown in the drawings.

DETAILED DESCRIPTION

Figure 1:
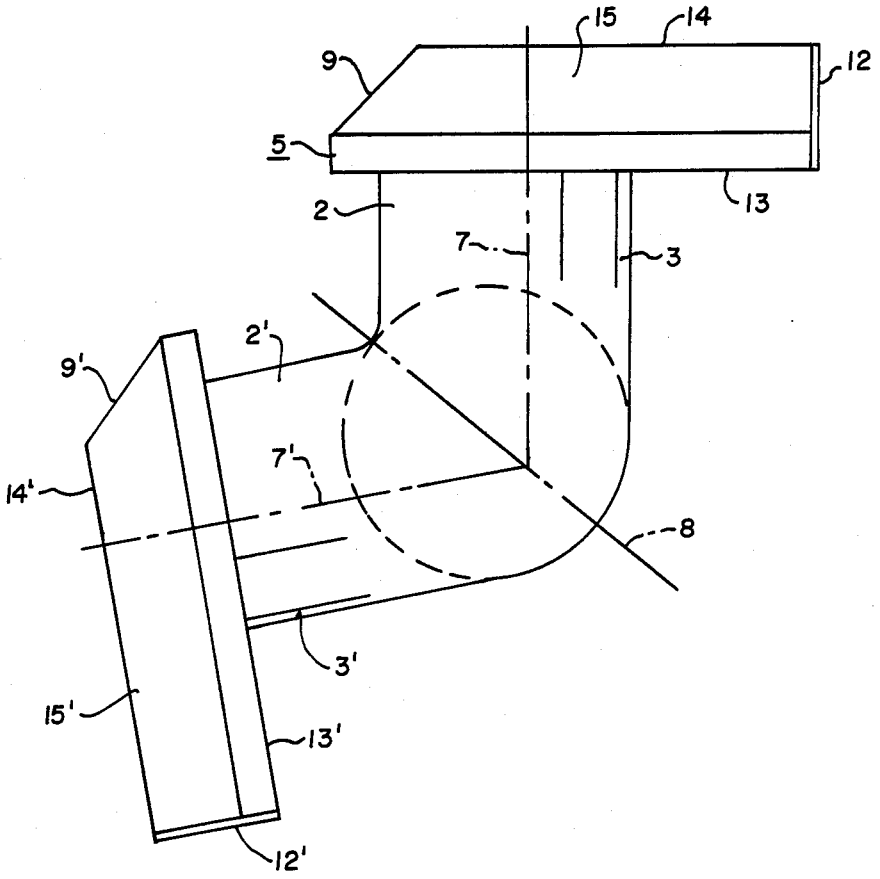
FIG. 1 shows a top plan view of the upper end of a lashing bar embodying principles of the present invention.

The shapes of the represented hooking-in fittings may correspond to those of the lashing bars of Borchardt U.S. Pat. No. 4,537,539 and it is also possible to provide in the case of the present lashing bar the configurations described in that prior patent, such as a rising construction of the pin from the bar in the direction of the hooking-in portion, an inclined position of the central axis of the bar with respect to the locking lug or with respect to its upwardly extending outer edge, etc.

Each of the identically-constructed hooking-in fittings shown in the drawings has pins 2, 2', in whose respective connecting zone each is fixed to the bar 1. Pins 2, 2' preferably project substantially at right angles to bar 1 or to the central axis 1' thereof or slope slightly upwards and outwards from the fixing area to bar 1.

Each of the hooking-in fittings has a locking lug 5 and an additional locking lug 10.

Figure 2:
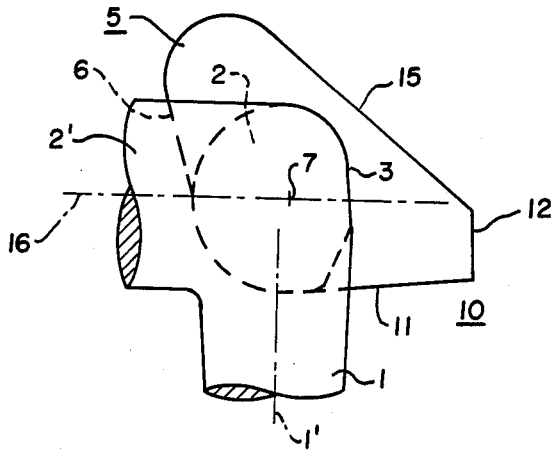
FIG. 2 shows in a fragmentary side elevation view a hooking-in portion, a part of the pin to which the other hooking-in portion (shown in FIG. 1 but not in FIG. 2) is fixed and part of the lashing bar extending downwards from the pin.

When the lashing bar extends vertically, with its two hooking-in fittings located at its top end, i.e. the orientation which is depicted in FIG. 2, locking lug 5 extends upwards, so that between its longitudinal axis or its lateral surface 6 and bar 1 or its central axis 1' an angle is formed, in the manner described in Borchardt U.S. Pat. No. 4,537,539. Locking lug 5 has a lateral surface 6 which is tangential with respect to the circular peripheral surface of pin 2 or 2' and at the free end passes into a curved surface. Over its largest zone 9 or 9', the outer surface of locking lug 5 extends at about 45° from the lateral surface 6 in the direction of the outer surface 14 or 14' of the additional locking lug 10, wherefor reference should be made to the explanations in Borchardt U.S. Pat. No. 4,537,539 in connection with the significance of chamfering 9 or 9'.

The additional locking lug 10 is in the same plane as locking lug 5 and has essentially the same thickness. It extends at right angles to locking lug 5, its tangential lateral surface 11 merging into the circular part of pin 2 or 2' being at an angle of 90° to the lateral surface 6 of locking lug 5. A transverse surface 15 or 15' extends from the end surface 12 or 12' at right angles to lateral surface 11, is common to both locking lugs 5 and 10 and is at an angle of 45° with respect to the lateral surfaces 6 and 11. Said transverse surface connects the end surface 12 or 12' to the curved upper end surface of locking lug 5. The circular cylindrical pin 2 or 2' passes via a larger radius, rounded portion which is tangentially connected to the lateral surface 11 of locking lug 10, into a substantially planar zone 3 or 3', which forms a right angle with the surface 13 or 13' of additional locking lug 10 or 10' facing pin 2 or 2', so that the longitudinal axis 7 or 7' of pin 2 or 2' in said zone is also at right angles to the plane of locking lug 5 and additional locking lug 10.

Figure 3:
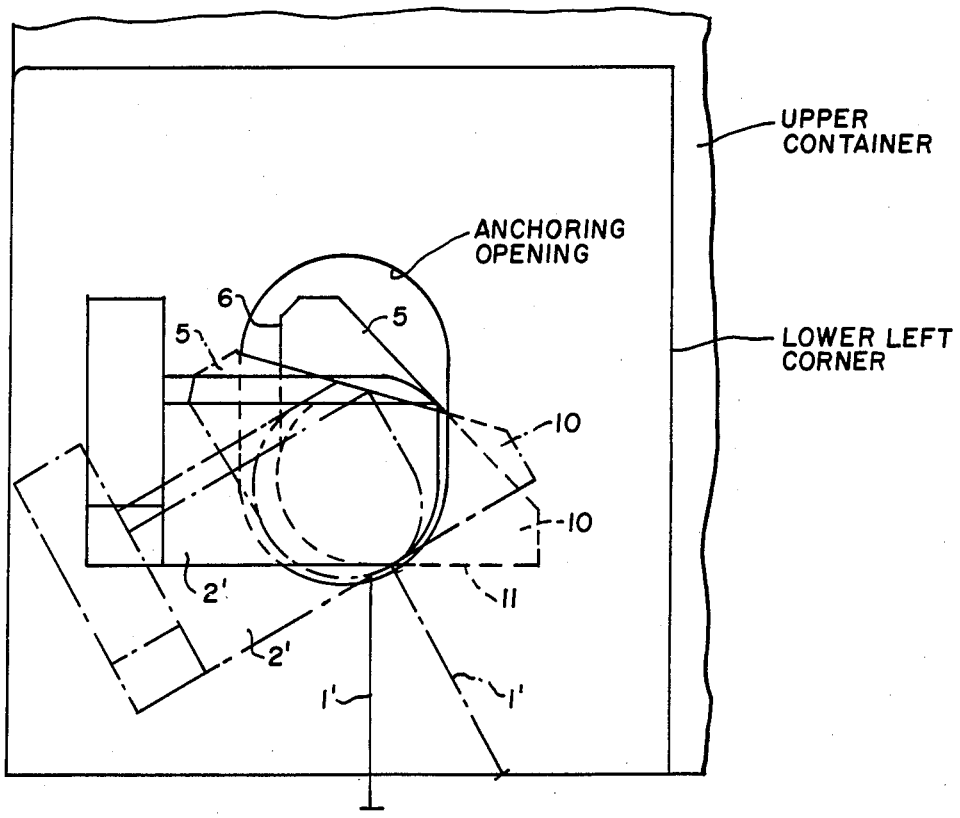
FIG. 3 is a fragmentary side elevation view, similar to FIG. 2, showing the hooking-in portion which is directed away from the viewer inserted through and hooked behind an anchoring opening of a standard shipping container.
Figure 4:
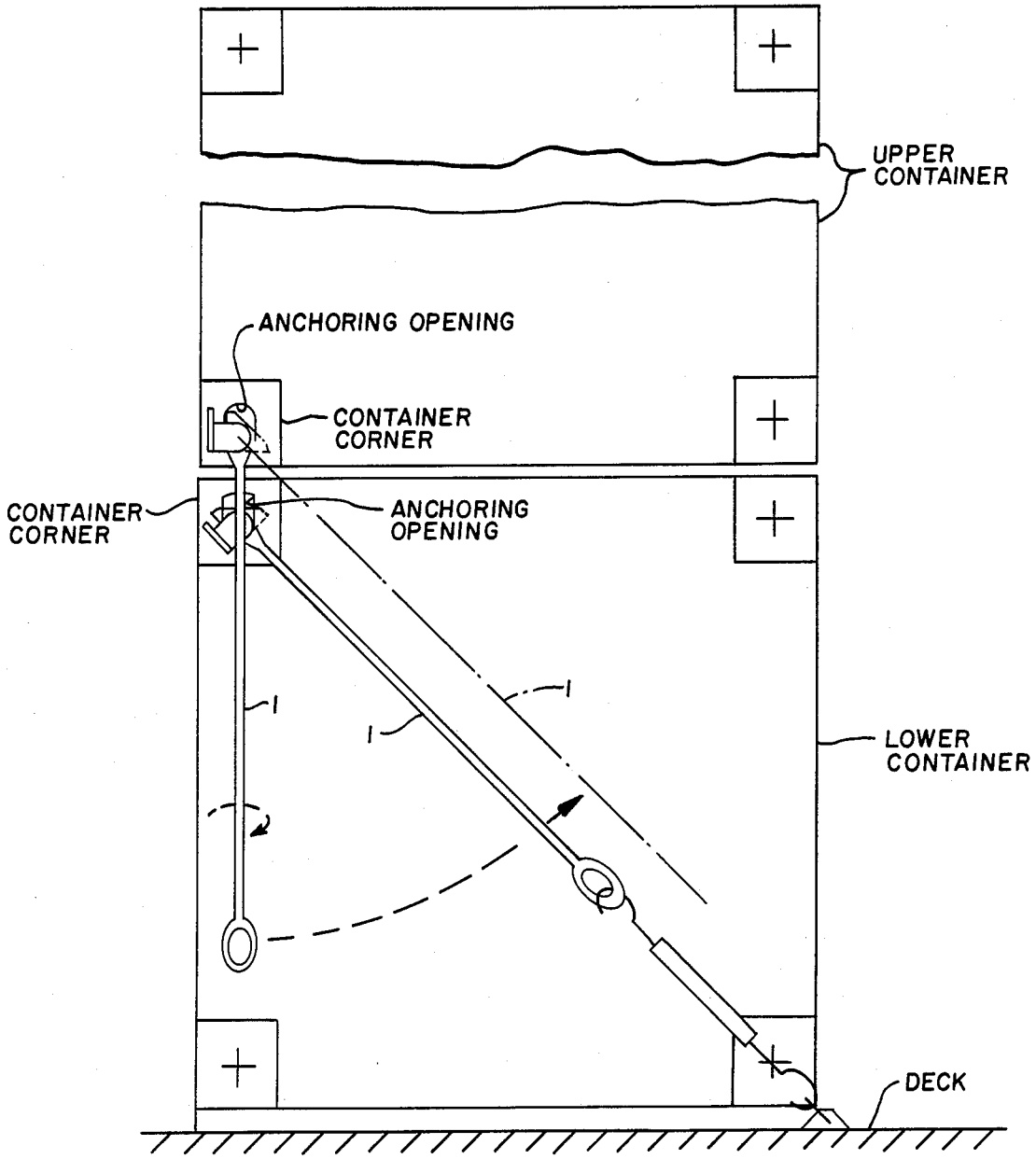
FIG. 4 is a smaller scale elevational view showing two standard shipping containers stacked on a deck, with an upper corner of the lower container having one hooking-in portion provided at the upper end of a first lashing bar securingly received therein, for lashing-down the lower container, and with an adjacent lower corner on a corresponding wall of the upper container having one hooking-in portion provided at the upper end of a second lashing bar securingly received therein for lashing-down the upper container without interference from the other hooking-in portion provided at the upper end of the first lashing bar.

The above-described construction of the hooking-in fittings with pins 2 or 2' and locking lugs 5 and 10 substantially corresponds to the construction of the hooking-in fittings according to Borchardt U.S. Pat. No. 4,357,359. In addition, the hooking-in fittings are arranged homologously to the plane 8 indicated in FIG. 1 and which passes through the central axis 1' of bar 1. It can also be seen that the additional locking lug 10 projects further laterally over a plane containing the central axis 1' of bar 1, and running parallel to the longitudinal axis 7' of pin 2, than the locking lug 5. Longitudinal axes 7, 7' of pins 2, 2' are not located in a common plane extending parallel to the central axis 1' of bar 1, i.e. they are not arranged at 180° to one another in FIG. 1 and, instead, longitudinal axes 7, 7' form an angle $\phi$ which is smaller than 180°. The spacing between the lateral end regions of the additional locking lugs located in the plane 16 (FIG. 2) normal to the central axis of bar 1 is greater than the spacing between the lateral end regions of the locking lugs located in the plane 16, so that the left, lower hooking-in fitting in FIG. 1 and in particular its hooking-in portion formed from the locking lug and the additional locking lug is located outside the region of an upper anchoring opening of a container corner in which is hung the hooking-in fitting formed from pin 2, locking lug 5 and additional locking lug 10. This makes it possible to hang a further lashing bar with its corresponding hooking-in fitting into the anchoring opening of a lower container corner of a container located directly above it and can be pivoted into the clamping position, without hanging into said anchoring opening being made difficult or impossible by the hooking-in fitting of the already hung-in lashing bar shown at the left, bottom of FIG. 1. See FIGS. 3 and 4.

Whilst the hooking-in fitting with pin 2, locking lug 5 and additional locking lug 10 is intended for a clamping position, in which the lower end of bar 1 in a view of the container wall having the associated anchoring opening is pivoted to the right with respect to the vertical axis of the anchoring opening, the hooking-in fitting shown at the left, bottom of FIG. 1 is intended for a clamping position in which the lower end of the bar is pivoted to the left with respect to the vertical axis of the anchoring opening. When using said hooking-in fitting, the latter with the pin 2, locking lug 5 and additional locking lug 10 is pivoted out of the region of the anchoring opening and does not prevent the hanging in of another lashing bar in an anchoring opening above it.

In the represented embodiment, the angle $\phi$, formed by the longitudinal axes 7, 7' of pins 2, 2' is approximately 100°. It is obviously also possible to reduce this angle, e.g. to 90° or even less, in order to move the free hooking-in fitting further out of the anchoring opening receiving the other hooking-in fitting without the position of the free hooking-in fitting hindering the hanging in of the other hooking-in fitting into the anchoring opening.

When an optimization of the position of the hooking-in fittings is obtained through the inclined position of pins 2, 2' and the hooking-in portions with respect to the central axis 1' or bar 1 described in Borchardt U.S. Pat. No. 4,537,539, the angle between the longitudinal axes 7, 7' can be increased to 165° or somewhat more. In this case, the additional lashing bar with its bar which has been rotated to become oblique during the hanging-in, can be passed adjacent to the additional locking lug of the free hooking-in fitting of the lashing bar already in the clamping position, so that hanging in is possible.

In the case of a lashing bar with a non-optimized position of the hooking-in fittings, the angle between the longitudinal axes 7, 7' can be increased to 120° or more and then the region around the end surface 12, 12' of the additional locking lug of the free hooking-in fitting is so far outside the region of the anchoring opening receiving the other hooking-in fitting that the hanging of a corresponding lashing bar into an anchoring opening above it is not impeded.

I claim:

1. A lashing bar for hanging in an anchoring opening of a container corner with two hooking-in fittings provided at the upper end of a bar which for each fitting has a pin extending substantially at a right angle to said bar and to which end is fixed a hooking-in portion, which is asymmetrical with respect to the plane in which the central axis of the bar is located and to which the longitudinal axis of the portion of the pin connected to the hooking-in portion is parallel, so that the first side of the hooking-in portion projects further sideways over the plane than the facing, second side and which in the case of a said hooking-in fitting hung into an anchoring opening and said bar pivoted into a clamping position engages behind marginal regions of the anchoring opening, whereby one of the hooking-in portions is constructed to engage behind the marginal regions of the anchoring opening when the lower end of said bar is pivoted towards one side of the extension of the vertical axis and the other hooking-in portion is constructed for engaging behind the marginal regions of the anchoring opening when the lower end of said bar is pivoted to the other side of the extension of the vertical axis and the two hooking-in portions are homologous to a plane located between them, characterized in that the longitudinal axes of the portions of pins connected to the hooking-in portions form an angle $\phi$ smaller than 180°, whereby in a plane normal to the central axis of bar the spacing between the lateral and regions of the first sides of the hooking-in portions is greater than the spacing between the lateral end regions of the second sides of the hooking-in portions.

2. A lashing bar according to claim 1, characterized in that the angle $\phi$ formed by the longitudinal axes is approximately 90° to 160°.

3. A lashing bar according to claim 2, characterized in that the angle $\phi$ formed by the longitudinal axes is approximately 90° to 120°.

4. A lashing bar securing a corner of a shipping container to another structure, such as a fitting on a ship deck, located at some distance from that corner of the shipping container, in an instance in which the container is provided at such corner with an anchoring fitting which includes a hollow structure having a cavity with an aperture opening outwardly of a respective face of the container, this aperture having a bounding surface extending thicknesswise of the hollow structure to said cavity, and this aperture being narrower in at least one direction across the facial area thereof so as to provide said cavity with a bounding wall surface adjoining said bounding surface of said aperture, said lashing bar, comprising:

an elongated bar portion having two opposite ends, one of said ends being provided with means securable to said other structure, and the other of said ends being provided with two alternately-usable hooking-in fittings, each comprising a generally planar, plate-like hooking-in portion, which faces generally radially away from said elongated bar portion, and a pin, which extends generally radially outwardly from a connection with said bar portion and connects with a rear face of a respective said hooking-in portion, for connecting that hooking-in portion to said bar portion;

each said hooking-in portion being asymmetrical with respect to an intersection of a respective imaginary plane which contains the longitudinal axis of said bar portion and is parallel to or contains the longitudinal axis of the respective said pin, so that the respective hooking-in portion extends laterally further to one side of such intersection than to the opposite side of such intersection;

said hooking-in fittings being symmetical to one another about a third imaginary plane which bisects an angle of intersection of the two first-mentioned said respective imaginary planes;

said angle of intersection being less than 180°;

said opposite sides of said intersections of said two first-mentioned respective imaginary planes lying closer to said third imaginary plane than do said one sides of said intersections;

one of said hooking-in portions being sized to be inserted through said aperture and into said cavity when said bar portion has a first spatial disposition and to become clamped against said bounding wall surface of said cavity when said bar portion is thereafter rotated in an arc of less than 90° in one angular direction about a generally horizontal axis to a second spatial disposition, when said corner is a right corner, and the other of said hooking-in portions being sized to be inserted through said aperture and into said cavity when said br portion has a first spatial disposition and to become clamped against said bounding wall surface of said cavity when said bar portion is thereafter rotated in an arc of less than 180° in an opposite angular direction about a generally horizontal axis to a second spatial disposition, when said corner is a left corner.

5. A lashing bar for incorporation in a lashing assembly for lashing containers to the deck of a ship, where the containers each have upper and lower corners provided with means defining anchoring openings with mouths of two different respective standard perimetrical figures, each opening being enlarged to the left, to the right and upwardly internally of its mouth so that a perimetrical edge is defined at the mouth to the left, to the right and upwardly of a lower lip thereof, where the standard perimetrical figure of each bottom corner end opening, each bottom corner side opening and each upper corner side opening is generally that of a vertically elongated rectangle with substantially semicircular upper and lower ends, and where the perimetrical figure of each upper corner end opening is generally that of a square with a substantially semi-circular lower end and a slightly arched upper end, said lower ends each providing a respective said lower lip, said lashing bar being constructed and engaged for alternative locking in said corner openings without regard to which of said two different standard perimetrical figures of mouth such corner openings have, and comprising:

a longitudinally elongated bar having a longitudinal axis and two opposite ends;

a hooking-in fitting provided on one end of said bar, this hooking-in fitting being adapted to be selectively, alternatively introduced into each of said openings and to clamp therein to the respective corner, by including:

a pin mounted on said one end of the bar, said pin having a longitudinal axis extending substantially perpendicularly to the longitudinal axis of the bar, this pin having an outer peripheral surface extending angularly about said longitudinal axis of said pin, and a first locking lug attached to the pin so as to have a base on the pin and a free end located remotely of the pin;

said first locking lug extending from base to free end, generally longitudinally of the bar, and from the pin in a direction away from the end of said bar which is opposite to said one end;

said first locking lug having a maximum width, measured transversally of its base, which is smaller than the maximum width of the mouth of each said standard lower corner anchoring opening;

the distance between said free end of said first locking lug and whichever is the furthest therefrom of (a) the furthest opposite side portion of said peripheral surface of said pin from where said first locking lug is based on said pin, and (b) the furthest extent of said first locking lug from said free end thereof, being smaller than the height of the mouth of each said standard lower corner anchoring opening, but sufficiently large as to permit said first locking lug, after entering a said standard upper corner end opening to engage the respective container upper corner marginally of the respective opening mouth from within the respective end opening upon angular displacement of said bar at least generally about said longitudinal axis of said pin toward a clamping position adjacent the respective container; said lashing bar being further characterized in having:

an additional locking lug attached to said pin so as to have a base on the pin and a free end located remotely of the pin;

said additional locking lug extending radially outwardly of the pin and being displaced angularly about said longitudinal axis of said pin from the first-described locking lug by an amount sufficient that when said bar is in said clamping position said additional locking lug engages the respective container upper corner marginally of the respective opening mouth from within the respective opening across the respective opening mouth from where said first-described locking lug is engaged;

said first locking lug and said additional locking lug comprising respective, plate-like members each having opposite faces, corresponding ones of which are substantially coplanar, and each having an edge which proceeds from the respective base to the respective free end to provide respective outer edge portions disposed relatively distally of one another, and around the respective free end and back to the respective base to provide respective inner edge portions disposed relatively proximally of one another;

the two said outer edge portions, respectively of said first locking lug and said additional locking lug extending tangentially of said peripheral surface of said pin, each from the respective said base toward the respective said end at respective sites disposed substantially 90° apart angularly of said peripheral surface;

said first and additional locking lugs being disposed on the pin relative to where the pin is mounted on the bar with such angular spacing between the free ends of the respective said locking lugs and the longitudinal axis of the bar, that, for insertion of the locking lugs of the hooking-in fitting into a said anchoring opening, the bar must be angled at about 5° to about 15° to vertical about the longitudinal axis of said pin while tilted outwards from having the longitudinal axis thereof lying in an imaginary verical plane sufficiently to permit the additional locking lug to be inserted through the respective said opening mouth above the respective said lower lip and hooked behind the respective said perimetrical edge to the left or to the right of, but above the respective said lower lip, tilted inwards to have said longitudinal axis thereof lie in an imaginary vertical plane and to cause said first locking lug to be inserted through the respective opening mouth, and, that for bringing the thus-inserted hooking-in fitting to its clamping position, the bar must be rotated through vertical about the longitudinal axis of said pin and then past vertical through another about 20° to about 50°, and neither during such insertion nor during such angling, outward tilting, inward tilting and rotating to said clamping position need either of said locking lugs pass below the said lower lip of the respective said opening while disposed within the respective said opening; and further including a replication of said hooking-in fitting on said one end of said bar, this replication having a mirror image angular orientation of its two locking lugs relative to its pin compared with that of the first-described hooking-in fitting, the two said pins extending from said bar at an included angle of less than 180° measured in a plane normal to the longitudinal axis of said bar, whereby said lashing bar is adapted to be selectively used in two angularly opposite clamping positions.

6. The lashing br of claim 5, wherein:

said peripheral surface of each said pin is generally cylindrically rounded but includes a flattened segment which at least generally faces the free end of the said additional locking lug of the respective hooking-in fitting.

7. The lashing bar of claim 5, wherein:

on each said hooking-in fitting, said respective outer edge portions extend at approximately a right angle to one another.

8. In combination, a deck having a first container stacked thereon and a second container stacked on said first container;

the first container being provided on one side thereof with left and right upper corner fittings;

the second container being provided on a corresponding side thereof with left and right lower corner fittings;

one of said upper corner fittings of said first container being vertically adjacent one of said lower corner fittings of said second container;

each said corner fitting being a hollow structure having a cavity with an aperture on the respective said side of the respective said container;

two lashing bars;

each said lashing bar having a generally vertically extending bar portion with a lower end which can be secured with respect to said deck when the respective lashing bar has said bar portion thereof disposed in a first selected angular orientation relative to vertical;

one said lashing bar further having two hooking-in fittings provided thereon at an upper end thereof which have respective plate-like hooking-in fittings which face laterally away from said bar portion with an angle of less than 180° being included between said hooking-in fittings in a plane which is transverse to the longitudinal axis of said bar portion;

said hooking-in fittings on said one lashing bar being alternately useful, depending on whether said one upper corner fitting is a left or a right upper corner fitting by being inserted through a respective said aperture into a respective said cavity in a respective said upper corner fitting when the respective lashing bar has said bar portion thereof disposed in a second selected angular orientation relative to vertical, but which becomes clamped to the respective said upper corner fitting when said bar portion is thereafter rotated from said second selected position to said first selected position;

said one lashing bar having said bar portion thereof in said first selected position thereof with one said hooking-in fitting thereof clamped in said one upper corner fitting and having said lower end thereof secured with respect to said deck;

the other said lashing bar further having at least one hooking-in fitting provided thereon at an upper end thereof, each of which hooking-in fitting has a respective plate-like hooking-in fitting which faces laterally away from said bar portion;

said at least one hooking-in fitting being useful by being inserted in said one lower corner fitting when the respective lashing bar has said bar portion thereof disposed in a second selected angular orientation relative to vertical, but which becomes clamped to the respective said lower corner fitting when said bar portion is thereafter rotated from said second selected position thereof to said first selected position thereof;

said hooking-in fittings on said one lashing bar being so spatially oriented that said bar portion of said other lashing bar may be rotated from said second selected position thereof to said first selected position thereof without hindering engagement with said one lashing bar;

said other lashing bar having said bar portion thereof in said first selected position thereof with said at least one hooking-in fitting thereof clamped in said one lower corner fitting and having said lower end thereof secured with respect to said deck.

* * * * *